US007011546B2

(12) United States Patent
Vaccaro

(10) Patent No.: US 7,011,546 B2
(45) Date of Patent: Mar. 14, 2006

(54) COAXIAL CONNECTOR WITH ENHANCED INSULATOR MEMBER AND ASSOCIATED METHODS

(75) Inventor: Ronald A. Vaccaro, Hickory, NC (US)

(73) Assignee: Commscope Properties, LLC, Sparks, NV (US)

( * ) Notice: Subject to any disclaimer, the term of this patent is extended or adjusted under 35 U.S.C. 154(b) by 0 days.

(21) Appl. No.: 10/935,729

(22) Filed: Sep. 7, 2004

(65) Prior Publication Data

US 2005/0079760 A1 Apr. 14, 2005

Related U.S. Application Data

(60) Provisional application No. 60/501,253, filed on Sep. 9, 2003.

(51) Int. Cl.
*H01R 9/05* (2006.01)

(52) U.S. Cl. ..... 439/580

(58) Field of Classification Search ..... 439/580, 439/578, 584, 579, 581–585; 174/89
See application file for complete search history.

(56) References Cited

U.S. PATENT DOCUMENTS 3,206,540 A * 9/1965 Cohen ..... 174/89
6,024,609 A 2/2000 Kooiman et al. ..... 439/675
6,217,380 B1 4/2001 Nelson et al. ..... 439/578
6,396,367 B1 5/2002 Rosenberger ..... 333/260
6,607,398 B1 8/2003 Henningsen ..... 439/578

FOREIGN PATENT DOCUMENTS

EP 1303005 A1 4/2003

* cited by examiner

*Primary Examiner*—Javaid H. Nasri
(74) *Attorney, Agent, or Firm*—Allen, Dyer, Doppelt, Milbrath & Gilchrist, P.A.

(57) ABSTRACT

A coaxial cable connector includes a connector housing, a back nut threadingly engaging a rearward end of the connector housing, a ferrule gripping and advancing an end of the coaxial cable into the connector housing as the back nut is tightened, and an insulator member positioned within a medial portion of the connector housing. The insulator member may have a bore extending therethrough and include a forward disk portion, a rearward disk portion, a ring portion connecting the forward and disk portions together, and a tubular outer conductor support portion extending rearwardly from the rearward disk portion for supporting an interior surface of the outer conductor of the end of the coaxial cable. The insulator member may an integrally formed monolithic member and the ring portion may have a reduced strength portion therein.

27 Claims, 2 Drawing Sheets

COAXIAL CONNECTOR WITH ENHANCED INSULATOR MEMBER AND ASSOCIATED METHODS

RELATED APPLICATION

This application is based upon and claims priority to prior filed provisional application No. 60/501,253 filed Sep. 9, 2003. The entire subject matter of this provisional application is incorporated herein by reference in its entirety.

FIELD OF THE INVENTION

The present invention relates to the field of cables and connectors, and, more particularly, to a connector for coaxial cables and associated methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter cable extending between the equipment shelter and the top of the antenna tower to thereby reduce signal losses. For example, CommScope, Inc. of Hickory, N.C. and the assignee of the present invention offers its CellReach® coaxial cable for such applications. The cable includes a smooth wall outer conductor that provides superior performance to other cable types. The smooth outer wall construction also provides additional ease of attaching connector portions to the cable ends in comparison to other coaxial cable types, such as including corrugated outer conductors, for example.

A typical coaxial cable connector for such a coaxial cable includes a tubular housing or body to make electrical connection to the cable outer conductor and a center contact to make electrical connection to the inner conductor of the coaxial cable. The center contact may include a tubular rearward end to receive the inner conductor of the coaxial cable. An insulator assembly supports the center contact concentrically within the housing. The insulator assembly may typically include multiple cooperating parts.

A typical connector may also include a gripping member or ferrule that is positioned onto the end of the outer conductor and adjacent the outer insulating jacket portion of the coaxial cable. The ferrule is axially advanced into the housing as a back nut is tightened onto the rearward end of the housing. One or more O-rings may be provided to environmentally seal the connector to prevent the ingress of water, for example, into the connector.

Representative patents directed to coaxial cable connectors include U.S. Pat. No. 6,396,367 B1 to Rosenberger; U.S. Pat. No. 6,024,609 to Kooiman et al.; U.S. Pat. No. 6,607,398 B2 to Henningsen; and U.S. Pat. No. 6,217,380 B1 to Nelson et al. The entire contents of each of these patents are incorporated herein by reference.

One important consideration in reducing the costs of connectors is the number of connector components that are manufactured and then assembled to produce the connector. Another consideration in connector design is accommodating the axial movement of the back nut and end of the cable into the connector housing as the back nut is tightened so that good electrical contact is maintained.

SUMMARY OF THE INVENTION

In view of the foregoing background, it is therefore an object of the present invention to provide a connector and associated methods that are less expensive and that accommodate tightening of the connector components together.

This and other objects, features and advantages in accordance with the invention are provided by a coaxial cable connector including a connector housing, a back nut threadingly engaging a rearward end of the connector housing, a ferrule gripping and advancing the cable end into the connector housing as the back nut is tightened, and an insulator member positioned within a medial portion of the connector housing. More particularly, the insulator member may have a bore extending therethrough and may include a forward disk portion, a rearward disk portion, a ring portion connecting the forward and disk portions together, and a tubular outer conductor support portion extending rearwardly from the rearward disk portion for supporting an interior surface of the outer conductor of the end of the coaxial cable. The connector may also include a contact received in the bore of the insulator member for connecting to the inner conductor of the end of the coaxial cable.

In accordance with one advantageous aspect of the present invention, the forward disk portion, the rearward disk portion, the ring portion, and the tubular outer conductor support portion may be integrally formed as a monolithic unit. Accordingly, the part count for the connector is reduced.

In accordance with another advantageous aspect of the invention the ring portion of the insulator member may comprise a reduced strength portion defining a crush zone to facilitate movement of the rearward disk portion toward the forward disk portion as the back nut is tightened onto the connector housing. For example, the reduced strength portion may comprise a reduced thickness portion.

The tubular outer conductor support portion may comprise a distal end having a reduced outer diameter to facilitate positioning within the outer conductor of the end of the coaxial cable. The tubular outer conductor support portion may also extend rearwardly from the rearward disk portion a length at least as great as a length of the ring portion.

The connector housing may have a tubular shape and comprise an externally threaded rearward end, and the back nut may comprise an internally threaded bore threading engaging the externally threaded rearward end of the connector housing. The connector may also include one or more sealing O-rings adjacent the back nut.

One method aspect is for making a coaxial cable connector comprising a connector housing, a back nut threadingly engaging a rearward end of the connector housing, a ferrule for gripping and advancing an end of the coaxial cable into the connector housing as the back nut is tightened onto the connector housing, an insulator member positioned within a medial portion of the connector housing and having a bore extending therethrough, and a contact received in the bore of the insulator member for connecting to an inner conductor of the end of the coaxial cable. The method may include integrally forming the insulator member as a monolithic body comprising a forward disk portion, a rearward disk portion, a ring portion connecting the forward and rearward disk portions together, and a tubular outer conductor support portion extending rearwardly from the rearward disk portion for supporting an interior surface of an outer conductor of the end of the coaxial cable.

Another method is also directed to making a coaxial cable connector. The method may comprise forming the insulator member to comprise a forward disk portion, a rearward disk portion, a ring portion connecting the forward and rearward disk portions together, and a tubular outer conductor support portion extending rearwardly from the rearward disk portion for supporting an interior surface of an outer conductor of the end of the coaxial cable. Moreover, forming the insulator member may comprise forming the ring portion to have a reduced strength portion defining a crush zone to facilitate movement of the rearward disk portion toward the forward disk portion as the back nut is tightened onto the connector housing.

DETAILED DESCRIPTION OF THE PREFERRED EMBODIMENTS

The present invention will now be described more fully hereinafter with reference to the accompanying drawing, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
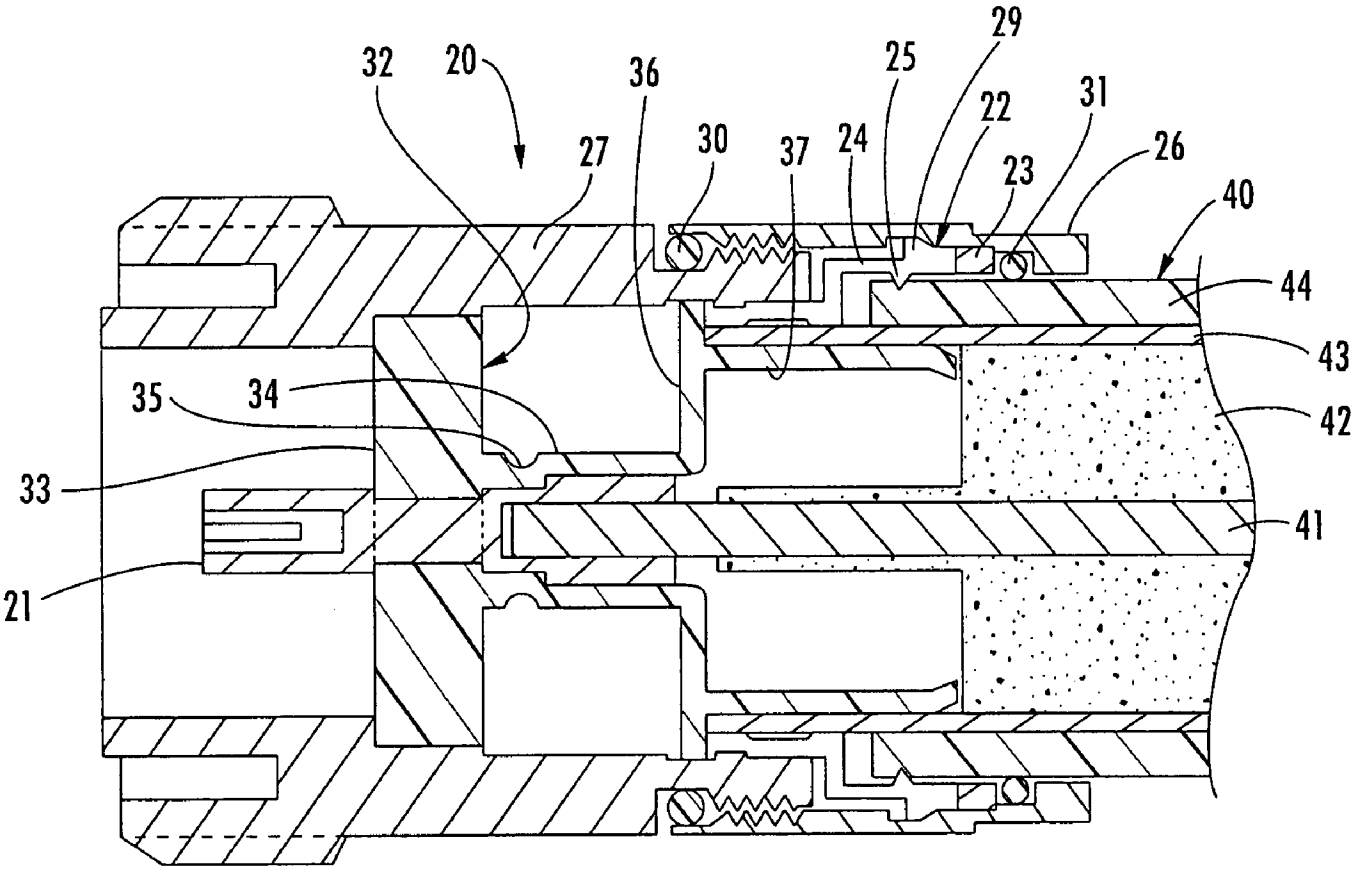
FIG. 1 is a transverse cross-sectional view of the connector being installed on the end of a coaxial cable in accordance with the present invention.

Referring now initially to FIG. 1, the coaxial connector 20 in accordance with the present invention is now described. The connector 20 is installed onto the end of a coaxial cable 40 that illustratively includes an inner conductor 41, a dielectric foam layer 42 surrounding the inner conductor, an outer conductor 43 surrounding the dielectric layer, and an outer insulating jacket 44 surrounding the outer conductor.

The end of the coaxial cable 40 is prepared so that the inner conductor 41 extends axially outwardly beyond the end of the outer conductor 43. In addition, portions of the dielectric foam layer 42 are also removed so that the inner surface of the outer conductor 43 is also exposed. The outer insulating jacket 44 is also stripped back a distance so that outer end portions of the outer conductor 43 are also exposed.

A ferrule 22 is positioned over the end of the outer conductor 43 and adjacent portions of the jacket 44 of the cable 40. The ferrule 22 includes a supporting band portion 23 and plurality of circumferentially spaced apart gripping members 24 carried by the supporting band portion. The ferrule 22 also includes inner tabs 25 and outer tabs 29 carried by each gripping member 24 as shown in the illustrated embodiment. The forward ends of the gripping members 24 wedge tightly between the outer conductor 43 and interior portions of the housing 27. The ferrule 22 may preferably be formed as single monolithic unit to thereby reduce the number of connector components and thereby reduce the overall cost of the connector 20.

The connector 20 includes an internally threaded back nut 26 threaded onto the externally threaded rearward end of the connector housing 27. As the back nut 26 is tightened, the end of the inner conductor 41 is positioned further into rearward end the center contact 21. The ferrule 22 is also compressed into secure engagement between the outer conductor 43 and the adjacent interior portions of the housing 27 as will be appreciated by those skilled in the art. A forward O-ring 30 and a rearward O-ring 31 are provided to seal respective forward and rearward interfaces adjacent the back nut 26 and prevent moisture ingress.

Figure 2:
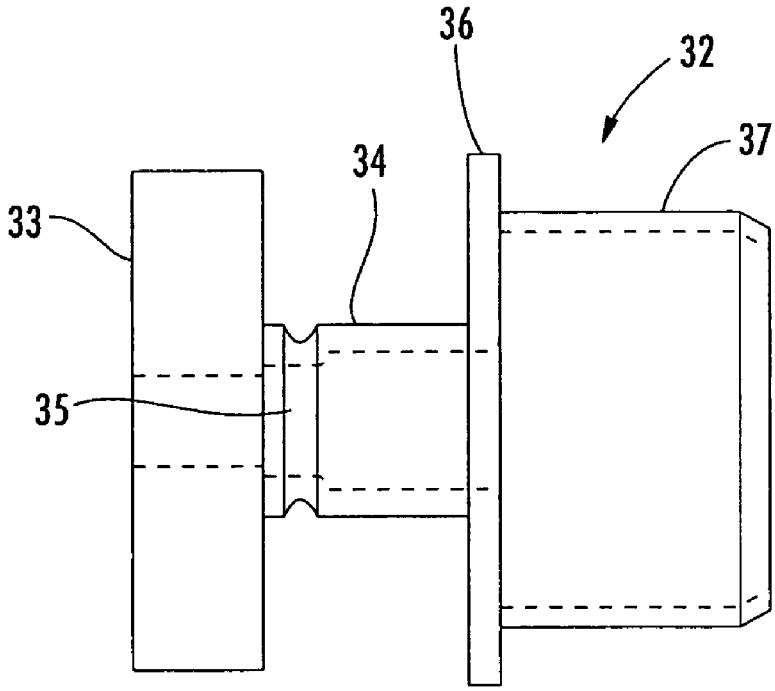
FIG. 2 is a side elevational view of the insulator member of the connector as shown in FIG. 1 prior to full tightening of the back nut and with the other connector components not shown for clarity of illustration.
Figure 3:
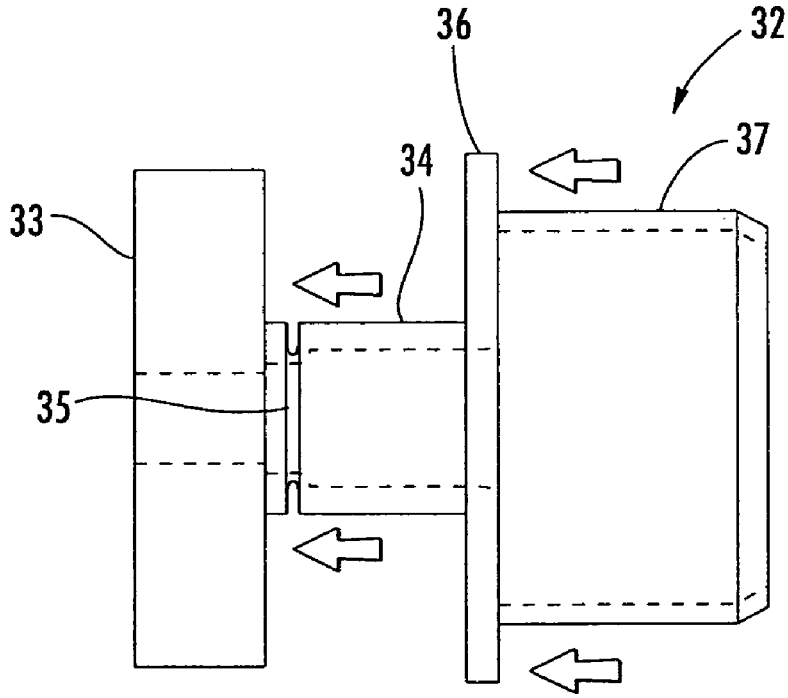
FIG. 3 is a side elevational view of the insulator member as shown in FIG. 2 after tightening of the back nut.

Turning now additionally to FIGS. 2 and 3, further advantageous features of the connector 20 are now described. The center contact 21 is illustratively supported in the housing 27 by an insulator member 32. The insulator member 32 includes a forward disk shaped portion 33, and a thinner rearward disk shaped portion 36 connected together by a ring shaped portion 34. This ring shaped portion 34 also includes a circumferential recess 35 therein to permit the ring shaped portion to crush or axially compress as shown in FIG. 3 as the back nut 26 is tightened onto the housing 27.

The insulator member 32 also includes a tubular outer conductor support portion 37 extending rearwardly from the rearward disk shaped portion 36. This tubular outer conductor support portion 37 presses against the interior surface of the outer conductor 43 to thereby ensure good electrical contact between the outer conductor and the ferrule 22 as will be appreciated by those skilled in the art. In some embodiments, the length of the tubular outer conductor support portion 37 may be at least as great as a length of the ring portion 34, for example.

The insulator member 32 may also be desirably formed as a single monolithic unit to reduce the number of components and thereby reduce the cost of the connector 20. For example, the insulator member 32 may be molded from plastic as will be appreciated by those skilled in the art. Accordingly, the connector 20 may be formed with as few as five main components and two O-rings. Significant cost savings are anticipated for such embodiments.

One method aspect is for making a coaxial cable connector 20 and may include integrally forming the insulator member 32 as a monolithic body comprising a forward disk portion 33, a rearward disk portion 36, a ring portion 34 connecting the forward and rearward disk portions together, and a tubular outer conductor support portion 37 extending rearwardly from the rearward disk portion for supporting an interior surface of an outer conductor 43 of the end of the coaxial cable.

Another method is also directed to making a coaxial cable connector. The method may comprise forming the insulator member 32 to comprise a forward disk portion 33, a rearward disk portion 36, a ring portion 34 connecting the forward and rearward disk portions together, and a tubular outer conductor support portion 37 extending rearwardly from the rearward disk portion for supporting an interior surface of an outer conductor of the end of the coaxial cable. Moreover, forming the insulator member 32 may comprise forming the ring portion 34 to have a reduced strength portion 35 defining a crush zone to facilitate movement of the rearward disk portion 36 toward the forward disk portion 33 as the back nut 26 is tightened onto the connector housing 27.

The connector 20 is illustratively in form of a female DIN connector. The features and advantages of this connector 20 as described herein may be used in other connector types, such as N-female, N-male, and DIN-male types of connectors, for example, as will be appreciated by those skilled in the art. The connector 20 may also be suitable for a ⅞ inch coaxial cable of the type commonly used for wireless base stations, for example. Such applications are also described in U.S. Pat. No. 6,217,380 assigned to the assignee of the present invention and the entire disclosure of which is incorporated herein by reference. The cable may be smooth wall or corrugated wall, for example. Other sizes and types of coaxial cable, and other applications are also contemplated by the invention.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included.

That which is claimed is:

1. A coaxial cable connector for a coaxial cable comprising a center conductor, a dielectric layer surrounding the center conductor, and an outer conductor surrounding the dielectric layer, the coaxial cable connector comprising:

a connector housing having a forward and rearward ends and a medial portion therebetween;

a back nut threadingly engaging the rearward end of said connector housing;

a ferrule gripping an end of the coaxial cable for advancing the end of the coaxial cable into said connector housing as said back nut is tightened onto rearward end of said connector housing;

an insulator member positioned within the medial portion of said connector housing, said insulator member having a bore extending therethrough and comprising a forward disk portion, a rearward disk portion, a ring portion connecting said forward and rearward disk portions together, and a tubular outer conductor support portion extending rearwardly from said rearward disk portion for supporting an interior surface of the outer conductor of the end of the coaxial cable; and a contact received in the bore of said insulator member for connecting to the inner conductor of the end of the coaxial cable.

2. A coaxial cable connector according to claim 1 wherein said forward disk portion, said rearward disk portion, said ring portion, and said tubular outer conductor support portion are integrally formed as a monolithic unit.

3. A coaxial cable connector according to claim 1 wherein said ring portion further comprises a reduced strength portion defining a crush zone to facilitate movement of said rearward disk portion toward said forward disk portion as said back nut is tightened onto the rearward end of said connector housing.

4. A coaxial cable connector according to claim 3 wherein said reduced strength portion comprises a reduced thickness portion.

5. A coaxial cable connector according to claim 1 wherein said tubular outer conductor support portion comprises a distal end having a reduced outer diameter to facilitate positioning within the outer conductor of the end of the coaxial cable.

6. A coaxial cable connector according to claim 1 wherein said tubular outer conductor support portion extends rearwardly from said rearward disk portion a length at least as great as a length of the ring portion.

7. A coaxial cable connector according to claim 1 wherein rearward end of said connector housing is externally threaded; and wherein said back nut comprises an internally threaded bore threading engaging the externally threaded rearward end of said connector housing.

8. A coaxial cable connector according to claim 1 further comprising at least one sealing O-ring adjacent said back nut.

9. A coaxial cable connector according to claim 8 wherein said at least one O-ring comprises forward and rearward O-rings.

10. A coaxial cable connector for a coaxial cable comprising a center conductor, a dielectric layer surrounding the center conductor, and an outer conductor surrounding the dielectric layer, the coaxial cable connector comprising:

a connector housing having a tubular shape with an externally threaded rearward end;

a back nut having an internally threaded bore threadingly engaging the externally threaded rearward end of said connector housing;

a ferrule gripping an end of the coaxial cable for advancing the end of the coaxial cable into said connector housing as said back nut is tightened onto the externally threaded reward end of said connector housing;

an insulator member positioned within a medial portion of said connector housing, said insulator member having a bore extending therethrough and comprising a forward disk portion, a rearward disk portion, a ring portion connecting said forward and rearward disk portions together, and a tubular outer conductor support portion extending rearwardly from said rearward disk portion for supporting an interior surface of the outer conductor of the end of the coaxial cable, said forward disk portion, said rearward disk portion, said ring portion, and said tubular outer conductor support portion being integrally formed as a monolithic unit; and a contact received in the bore of said insulator member for connecting to the inner conductor of the end of the coaxial cable.

11. A coaxial cable connector according to claim 10 wherein said ring portion further comprises a reduced strength portion defining a crush zone to facilitate movement of said rearward disk portion toward said forward disk portion as said back nut is tightened onto the externally threaded rearward end of said connector housing.

12. A coaxial cable connector according to claim 11 wherein said reduced strength portion comprises a reduced thickness portion.

13. A coaxial cable connector according to claim 10 wherein said tubular outer conductor support portion comprises a distal end having a reduced outer diameter to facilitate positioning within the outer conductor of the end of the coaxial cable.

14. A coaxial cable connector according to claim 10 wherein said tubular outer conductor support portion extends rearwardly from said rearward disk portion a length at least as great as a length between said forward disk portion and said rearward disk portion.

15. A coaxial cable connector according to claim 10 further comprising at least one sealing O-ring adjacent said back nut.

16. A coaxial cable connector for a coaxial cable comprising a center conductor, a dielectric layer surrounding the center conductor, and an outer conductor surrounding the dielectric layer, the coaxial cable connector comprising:

a connector housing having a tubular shape with an externally threaded rearward end;

a back nut having an internally threaded bore threadingly engaging the externally threaded rearward end of said connector housing;

a ferrule gripping an end of the coaxial cable for advancing the cable end into said connector housing as said back nut is tightened onto the externally threaded rearward end of said connector housing;

an insulator member positioned within a medial portion of said connector housing, said insulator member having a bore extending therethrough and comprising a forward disk portion, a rearward disk portion, a ring portion connecting said forward and rearward disk portions together, and a tubular outer conductor support portion extending rearwardly from said rearward disk portion for supporting an interior surface of the outer conductor of the end of the coaxial cable, said ring portion comprising a reduced strength portion defining a crush zone to facilitate movement of said rearward disk portion toward said forward disk portion as said back nut is tightened onto the externally threaded rearward end of said connector housing; and a contact received in the bore of said insulator member for connecting to the inner conductor of the end of the coaxial cable.

17. A coaxial cable connector according to claim 16 wherein said reduced strength portion comprises a reduced thickness portion.

18. A coaxial cable connector according to claim 16 wherein said tubular outer conductor support portion comprises a distal end having a reduced outer diameter to facilitate positioning within the outer conductor of the end of the coaxial cable.

19. A coaxial cable connector according to claim 16 wherein said tubular outer conductor support portion extends rearwardly from said rearward disk portion a length at least as great as a length of the ring portion.

20. A coaxial cable connector according to claim 16 further comprising at least one sealing O-ring adjacent said back nut.

21. A method for making a coaxial cable connector comprising a connector housing, a back nut threadingly engaging a rearward end of the connector housing, a ferrule for gripping and advancing an end of the coaxial cable into the connector housing as the back nut is tightened onto the connector housing, an insulator member positioned within a medial portion of the connector housing and having a bore extending therethrough, and a contact received in the bore of the insulator member for connecting to an inner conductor of the end of the coaxial cable, the method comprising:

integrally forming the insulator member as a monolithic body comprising a forward disk portion, a rearward disk portion, a ring portion connecting the forward and rearward disk portions together, and a tubular outer conductor support portion extending rearwardly from the rearward disk portion for supporting an interior surface of an outer conductor of the end of the coaxial cable.

22. A method according to claim 21 wherein integrally forming the insulator member comprises forming the ring portion to have a reduced strength portion defining a crush zone to facilitate movement of the rearward disk portion toward the forward disk portion as the back nut is tightened onto the connector housing.

23. A method according to claim 22 wherein the reduced strength portion comprises a reduced thickness portion.

24. A method according to claim 21 wherein integrally forming the insulator member comprises forming a distal end of the tubular outer conductor support portion to have a reduced outer diameter to facilitate positioning within the outer conductor of the end of the coaxial cable.

25. A method for making a coaxial cable connector comprising a connector housing, a back nut threadingly engaging a rearward end of the connector housing, a ferrule for gripping and advancing an end of the coaxial cable into the connector housing as the back nut is tightened onto the connector housing, an insulator member positioned within a medial portion of the connector housing and having a bore extending therethrough, and a contact received in the bore of the insulator member for connecting to an inner conductor of the end of the coaxial cable, the method comprising:

forming the insulator member to comprise a forward disk portion, a rearward disk portion, a ring portion connecting the forward and rearward disk portions together, and a tubular outer conductor support portion extending rearwardly from the rearward disk portion for supporting an interior surface of an outer conductor of the end of the coaxial cable; and wherein forming the insulator member comprises forming the ring portion to have a reduced strength portion defining a crush zone to facilitate movement of the rearward disk portion toward the forward disk portion as the back nut is tightened onto the connector housing.

26. A method according to claim 25 wherein the reduced strength portion comprises a reduced thickness portion.

27. A method according to claim 25 wherein forming the insulator member comprises forming a distal end of the tubular outer conductor support portion to have a reduced outer diameter to facilitate positioning within the outer conductor of the end of the coaxial cable.

* * * * *